US009859078B2

(12) United States Patent
Kubono et al.

(10) Patent No.: US 9,859,078 B2
(45) Date of Patent: Jan. 2, 2018

(54) ELECTROMAGNETIC RELAY

(71) Applicant: FUJITSU COMPONENT LIMITED, Tokyo (JP)

(72) Inventors: Kazuo Kubono, Tokyo (JP); Yoichi Hasegawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/320,357

(22) PCT Filed: Jun. 22, 2015

(86) PCT No.: PCT/JP2015/067838

§ 371 (c)(1),
(2) Date: Dec. 20, 2016

(87) PCT Pub. No.: WO2016/002553

PCT Pub. Date: Jan. 7, 2016

(65) Prior Publication Data

US 2017/0162354 A1 Jun. 8, 2017

(30) Foreign Application Priority Data

Jul. 3, 2014 (JP) ..... 2014-138120

(51) Int. Cl.
*H01H 1/00* (2006.01)
*H01H 50/54* (2006.01)
*H01H 1/06* (2006.01)

(52) U.S. Cl.
CPC ..... *H01H 50/54* (2013.01); *H01H 1/06* (2013.01)

(58) Field of Classification Search
CPC ..... H01H 50/14; H01H 50/02; H01H 50/22; H01H 50/24; H01H 50/28; H01H 50/36;
(Continued)

(56) References Cited

U.S. PATENT DOCUMENTS 3,017,474 A * 1/1962 Huetten ..... H01H 50/20 335/179
5,041,870 A * 8/1991 Imai ..... H01H 50/042 335/202

(Continued)

FOREIGN PATENT DOCUMENTS

JP S54-131956 U 9/1979
JP S56-037415 U 4/1981

(Continued)

*Primary Examiner* — Shawki S Ismail
*Assistant Examiner* — Lisa Homza
(74) *Attorney, Agent, or Firm* — IPUSA, PLLC

(57) ABSTRACT

An electromagnetic relay includes a fixed contact having a fixed contact plate and a fixed contact point mounted to the fixed contact plate, a movable contact having a movable contact plate and a movable contact point mounted to the movable contact plate, and an electromagnet device configured to move the movable contact so as to bring the movable contact point in contact with the fixed contact point, wherein a contact plate that is at least one of the fixed contact plate and the movable contact plate has a contact area, the contact area being thinner than other areas of the contact plate and having a penetrating hole formed therethrough, and the contact point of the contact plate has a head and a shaft, and wherein while the shaft is placed in the penetrating hole such that the head is mounted on a first surface of the contact area, an end of the shaft is deformed with a force at a second surface opposite the first surface to mount the contact point to the contact plate.

5 Claims, 7 Drawing Sheets

(58) Field of Classification Search
CPC ..... H01H 50/38; H01H 50/54; H01H 50/56; H01H 50/58; H01H 50/60; H01H 1/06; H01H 33/182
USPC ..... 335/196
See application file for complete search history.

(56) References Cited

U.S. PATENT DOCUMENTS 5,239,281 A * 8/1993 Tomono ..... H01H 50/042 335/128
6,265,958 B1 * 7/2001 Yoshino ..... H01H 50/023 335/128
6,359,537 B1 * 3/2002 Ichikawa ..... H01H 49/00 335/78
6,496,090 B1 * 12/2002 Nishida ..... H01H 50/023 335/128
6,879,229 B2 * 4/2005 Tanaka ..... H01H 50/46 335/128
6,903,639 B2 * 6/2005 Sanada ..... H01H 50/443 335/129
6,922,122 B2 * 7/2005 Saruwatari ..... H01H 50/642 335/113
6,924,719 B2 * 8/2005 Saruwatari ..... H01H 50/08 335/17
6,933,815 B2 * 8/2005 Saruwatari ..... H01H 50/08 335/17
7,205,870 B2 * 4/2007 Sanada ..... H01H 50/642 335/128
8,164,404 B2 * 4/2012 Kamiya ..... H01H 9/04 218/157
8,493,164 B2 * 7/2013 Kurihara ..... H01H 50/047 335/78
2002/0036556 A1 * 3/2002 Matsuda ..... H01H 50/12 335/78
2004/0119566 A1 * 6/2004 Sanada ..... H01H 50/642 335/128
2005/0046527 A1 * 3/2005 Chida ..... H01H 50/002 335/78
2005/0057332 A1 * 3/2005 Nakamura ..... H01H 50/042 335/128
2006/0022778 A1 * 2/2006 Minowa ..... H01H 50/36 335/128
2008/0180197 A1 * 7/2008 Kubono ..... H01H 50/043 335/78
2009/0134962 A1 * 5/2009 Nishida ..... H01H 50/56 335/207
2010/0117769 A1 * 5/2010 Kuo ..... H01H 50/026 335/78
2011/0254645 A1 * 10/2011 Kubono ..... H01H 50/14 335/127
2013/0257566 A1 * 10/2013 Li ..... H01H 51/22 335/127
2014/0022035 A1 * 1/2014 Yamashita ..... H01H 9/443 335/201
2014/0159837 A1 * 6/2014 Hiraiwa ..... H01H 9/443 335/201
2015/0042425 A1 * 2/2015 Sumino ..... H01H 50/643 335/189
2015/0048909 A1 * 2/2015 Heinrich ..... H01H 50/041 335/85
2016/0027602 A1 * 1/2016 Hasegawa ..... H01H 50/58 335/189
2016/0086754 A1 * 3/2016 Shimoda ..... H01H 50/28 335/2
2016/0372286 A1 * 12/2016 Kubono ..... H01H 9/443
2017/0133183 A1 * 5/2017 Hasegawa ..... H01H 50/14
2017/0162353 A1 * 6/2017 Kubono ..... H01H 50/28

FOREIGN PATENT DOCUMENTS

JP S59-203319 11/1984
JP S62-089745 U 6/1987
JP 02189828 A * 7/1990
JP H02-099524 U 8/1990
JP H03-058818 U 6/1991
JP H08-017319 1/1996
JP 2005-243244 9/2005

* cited by examiner

ELECTROMAGNETIC RELAY

TECHNICAL FIELD

The disclosures herein relate to an electromagnetic relay.

BACKGROUND ART

Electromagnetic relays for opening and closing contacts in response to an input electrical signal have been widely used. In general, an electromagnetic relay has a fixed contact, a movable contact coming in contact with the fixed contact, and an electromagnet device for driving the movable contact. Each of the fixed contact and the movable contact has a contact spring and a contact point. Various configurations of these have been studied from the perspective of size reduction, quality and durability improvements, etc.

RELATED-ART DOCUMENTS

Patent Document

[Patent Document 1] Japanese Patent Post-Grant Publication No. 4-32486

[Patent Document 2] Japanese Patent Application Publication No. 2005-243244

[Patent Document 3] Japanese Utility Model Publication No. 62-89745

[Patent Document 4] Japanese Utility Model Post-Grant Publication No. 6-20260

SUMMARY OF THE INVENTION

Problem to be Solved by the Invention

As a further note, electromagnetic relays are required to have a configuration that can quickly extinguish arc discharge occurring between a fixed contact and a movable contact.

In consideration of the above, it may be desired to improve the performance of extinguishing arc discharge in an electromagnetic relay.

Means to Solve the Problem

An electromagnetic relay includes a fixed contact having a fixed contact plate and a fixed contact point mounted to the fixed contact plate, a movable contact having a movable contact plate and a movable contact point mounted to the movable contact plate, and an electromagnet device configured to move the movable contact so as to bring the movable contact point in contact with the fixed contact point, wherein a contact plate that is at least one of the fixed contact plate and the movable contact plate has a contact area, the contact area being thinner than other areas of the contact plate and having a penetrating hole formed therethrough, and the contact point of the contact plate has a head and a shaft, and wherein while the shaft is placed in the penetrating hole such that the head is mounted on a first surface of the contact area, an end of the shaft is deformed with a force at a second surface opposite the first surface to mount the contact point to the contact plate.

Advantage of the Invention

According to at least one embodiment, the performance of extinguishing arc discharge in an electromagnetic relay can be improved.

MODE FOR CARRYING OUT THE INVENTION

In the following, embodiments of the present invention will be described with reference to the accompanying drawings. In the specification and drawings, elements having substantially the same functions or configurations are referred to by the same numerals, and a duplicate description thereof will be omitted.

First Embodiment

<1. Entire Configuration of Electromagnetic Relay>

Figure 1:
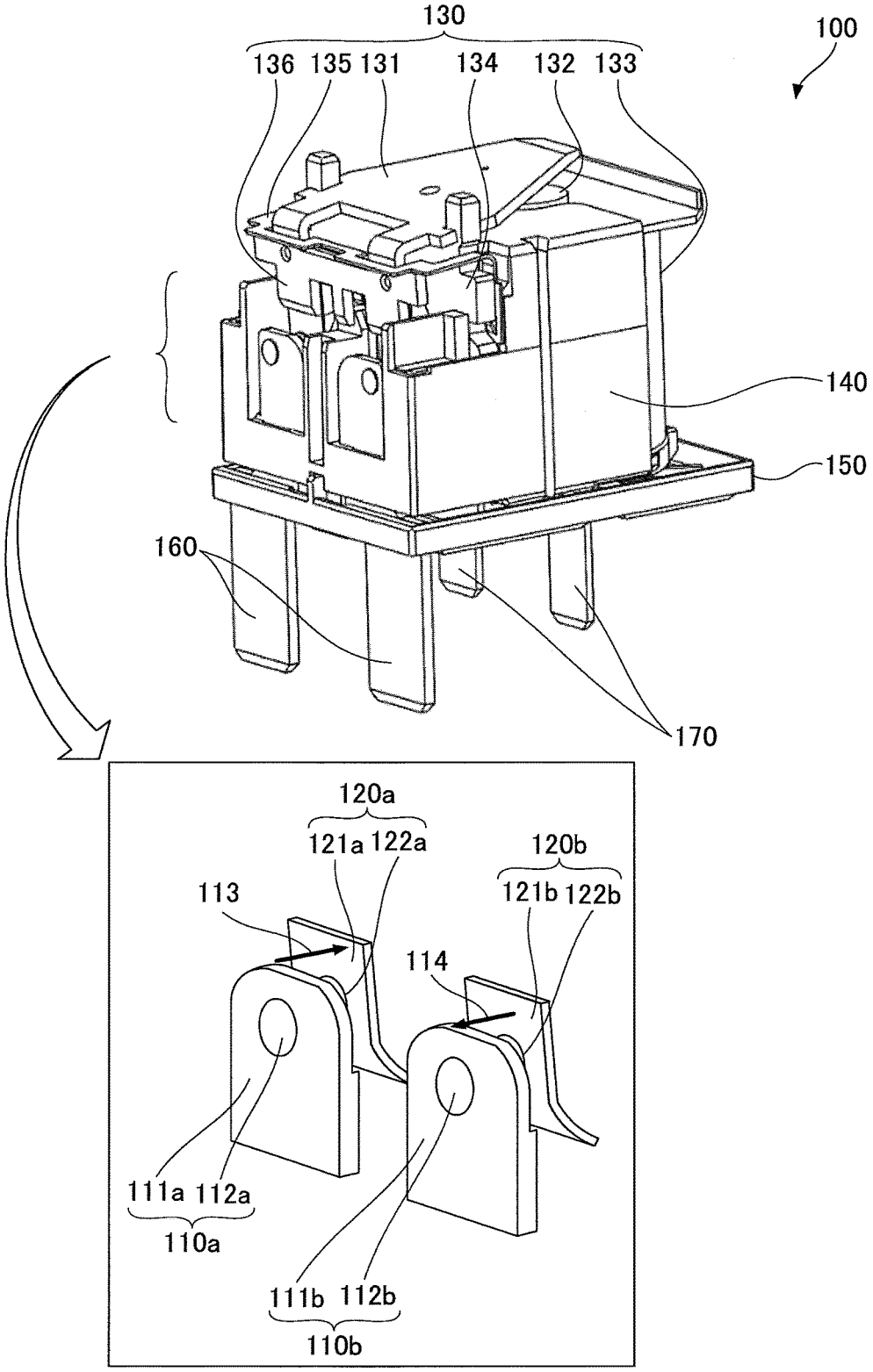
FIG. 1 is a drawing illustrating the entire configuration of an electromagnetic relay.

The entire configuration of an electromagnetic relay according to the present embodiment will be described first. FIG. 1 is a drawing illustrating the entire configuration of an electromagnetic relay and a portion thereof in an enlarged view as observed when an outside cover is removed.

As illustrated in FIG. 1, an electromagnetic relay 100 includes fixed contacts 110*a* and 110*b*, movable contacts 120*a* and 120*b*, and an electromagnet device 130. The fixed contacts 110*a* and 110*b*, the movable contacts 120*a* and 120*b*, and the electromagnet device 130 are secured with a base mold 140 and a bottom plate 150. Further, the bottom plate 150 has terminals 160 and 170 protruding from the lower face thereof.

The fixed contacts 110*a* and 110*b* include fixed contact springs (fixed contact plates) 111*a* and 111*b* and fixed contact points 112*a* and 112*b*, respectively. The fixed contact springs 111*a* and 111*b* are coupled to the two terminals 160, respectively. Similarly, the movable contacts 120*a* and 120*b* include movable contact springs (movable contact plates) 121*a* and 121*b* and movable contact points 122*a* and 122*b*, respectively, which are disposed to face the fixed contact springs 111*a* and 111*b* and the fixed contact points 112*a* and 112*b*, respectively. The two movable contact springs 121*a* and 121*b* are coupled to an armature 131 through a retaining member 136.

The electromagnet device 130 includes the armature 131, an iron core 132, a wire coil 133, a drive yoke 134, a hinge spring 135, and the retaining member 136.

The armature 131 is configured to rotate around the upper end of the drive yoke 134 serving as a pivot point. The rotational movement of the armature 131 around the upper end of the drive yoke 134 serving as a pivot point causes the movable contacts 120*a* and 120*b* coupled to the armature 131 through the retaining member 136 to move back and forth between the contact position and the noncontact position. The contact position refers to the position at which the movable contact points 122*a* and 122*b* are in contact with the fixed contact points 112*a* and 112*b*, respectively. The noncontact position refers to the position at which the movable contact points 122*a* and 122*b* are not in contact with the fixed contact points 112*a* and 112*b*, respectively.

The armature 131 adheres to or separates from an end face (i.e., iron core face) of the iron core 132. Specifically, applying voltage to the terminals 170 coupled to the wire coil 133 serves to generate an electromagnetic force, by which the armature 131 is brought in contact with the iron face. Consequently, the movable contacts 120*a* and 120*b* move to the contact position. As the movable contacts 120*a* and 120*b* move to the contact position, one of the terminals 160 (e.g., the terminal on the left-hand side in FIG. 1) is electrically coupled to the other one of the terminals 160 (e.g., the terminal on the right-hand side in FIG. 1). At this time, electric current flows from the one of the terminals 160 to the fixed contact spring 111*a*, and flows in the direction of an arrow 113 between the fixed contact point 112*a* and the movable contact point 122*a*. The electric current further flows from the movable contact point 122*a* to the movable contact springs 121*a* and 121*b*, and then flows in the direction of an arrow 114 between the movable contact point 122*b* and the fixed contact point 112*b*. The electric current further flows from the fixed contact point 112*b* to the fixed contact spring 111*b*, and then to the other one of the terminals 160.

The hinge spring 135 urges the armature 131 in the direction in which the armature 131 separates from the iron core face. Since the hinge spring 135 constantly applies an urging force to the armature 131 in the direction in which the armature 131 separates from the iron core face, the stoppage of application of voltage to the terminals 170 causes the armature 131 to separate from the iron core face, resulting in the movable contacts 120*a* and 120*b* moving to the noncontact position. Until voltage is applied to the terminals 170 next time, the movable contacts 120*a* and 120*b* stay at the noncontact position.

<2. Function to Extinguish Arc Discharge (Part 1)>

In the following, the function to extinguish arc discharge will be described. Arc discharge is a discharge phenomenon occurring when a connection is made or broken between the fixed contact point 112*a* and the movable contact point 122*a* and between the fixed contact point 112*b* and the movable contact point 122*b*. In the case of the electromagnetic relay 100, the passage of a prolonged time spent to extinguish arc discharge means a prolonged time needed to break an electrical connection between the fixed contact point and the corresponding movable contact point. Namely, even after the armature 131 separates from the iron core 132 to break a physical contact between the fixed contact point and the movable contact point, a certain length of time is required to pass before the electrical connection is broken.

In consideration of this, the electromagnetic relay 100 of the present embodiment has the function to promptly extinguish arc discharge by applying a magnetic field to the fixed contact points 112*a* and 112*b* and to the movable contact points 122*a* and 122*b* sideways from both lateral directions to generate the Lorenz force.

Figure 2A:
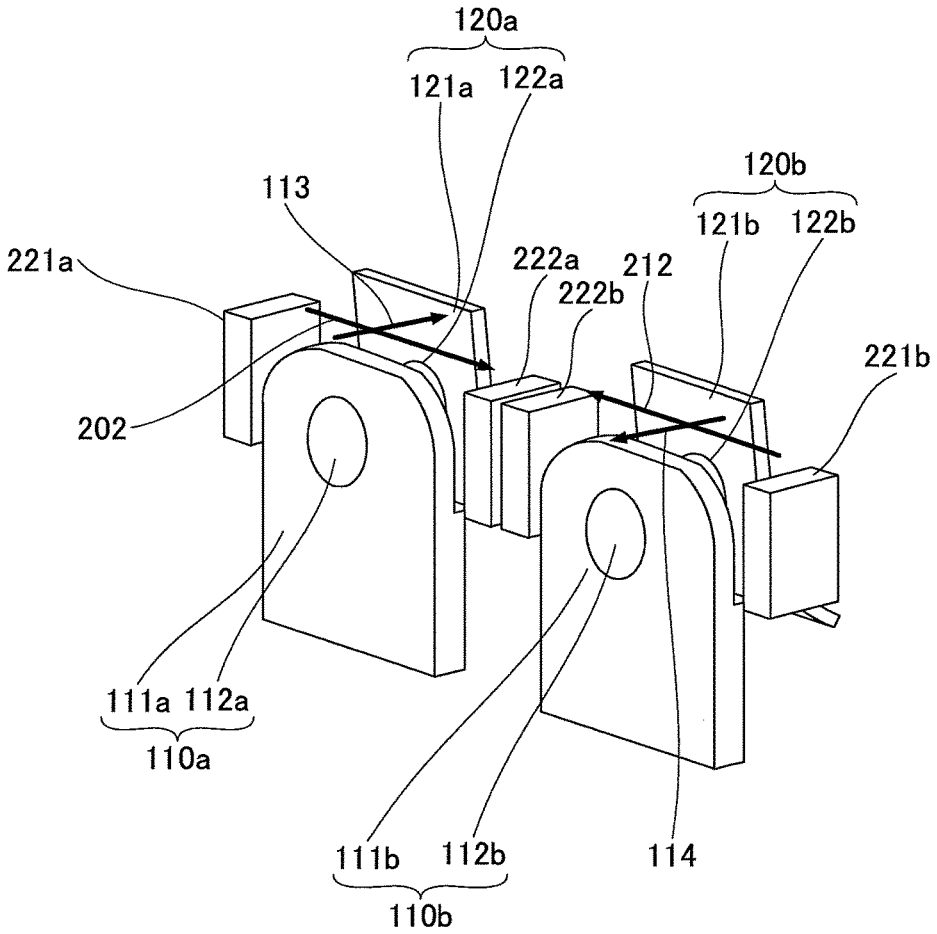
FIG. 2A is a drawing for explaining the function to extinguish arc discharge.

FIG. 2A is an enlarged view of the fixed contacts 110*a* and 110*b* and the movable contacts 120*a* and 120*b* for illustrating the suppression of arc discharge. In FIG. 2A, an arrow 113 indicates the direction of electric current Ia flowing between the fixed contact point 112*a* and the movable contact point 122*a*. An arrow 202 indicates the direction of a magnetic field Ba generated by permanent magnets 221*a* and 222*a* disposed at the lateral sides of the fixed contact point 112*a* and the movable contact point 122*a*.

Figure 2B:
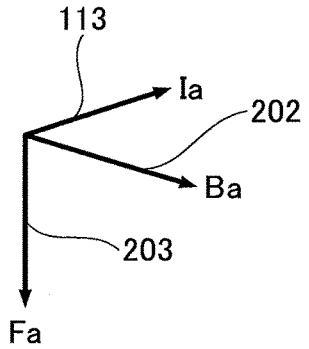
FIG. 2B is a drawing for explaining the function to extinguish arc discharge.

The flow of the electric current Ia in the direction of the arrow 113 under the presence of the magnetic field Ba in the direction of the arrow 202 serves to generate a Lorenz force Fa in the direction of an arrow 203 as illustrated in FIG. 2B. Because of this, the arc discharge occurring between the contact points is blown away in the direction Fa, which promptly extinguishes the arc discharge.

Similarly, an arrow 114 in FIG. 2A indicates the direction of electric current Ib flowing between the fixed contact point 112*b* and the movable contact point 122*b*. An arrow 212 indicates the direction of a magnetic field Bb generated by permanent magnets 221*b* and 222*b* disposed at the lateral sides of the fixed contact point 112*b* and the movable contact point 122*b*.

Figure 2C:
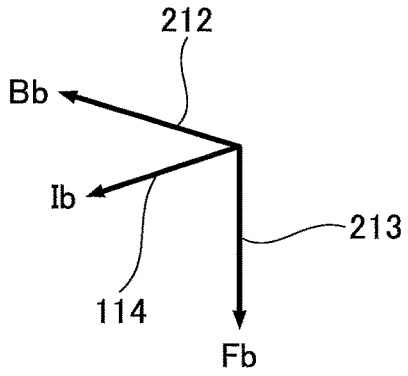
FIG. 2C is a drawing for explaining the function to extinguish arc discharge.

The flow of the electric current Ib in the direction of the arrow 114 under the presence of the magnetic field Bb in the direction of the arrow 212 serves to generate a Lorenz force Fb in the direction of an arrow 213 as illustrated in FIG. 2C. Because of this, the arc discharge occurring between the contact points is blown away in the direction Fb, which promptly extinguishes the arc discharge.

As is clearly understood from FIGS. 2B and 2C, the direction of the Lorenz force Fa and the direction of the Lorenz force Fb are the same. Namely, the direction of the Lorenz force Fa and the direction of the Lorenz force Fb are set to the same direction by properly arranging the magnetic poles of the permanent magnets 221*a*, 222*a*, 221*b*, and 222*b* while taking into account the directions in which the electric current Ia and the electric current Ib flow.

<3. Function to Extinguish Arc Discharge (Part 2)>

In the following, the arc-extinguishing function of the electromagnetic relay 100 according to the present embodiment will be further described. In order to promptly extinguish arc discharge, the electromagnetic relay 100 of the present embodiment not only generates the Lorenz forces Fa and Fb, but also employs the configuration that avoids abrupt surface changes between the fixed contact point and the fixed contact spring in the direction in which the Lorenz forces Fa and Fb are applied. An abrupt surface change such as a step between the fixed contact point and the fixed contact spring would cause arc discharge to be regenerated at the step of the like, thereby acting against the prompt suppression of arc discharge.

Figure 3A:
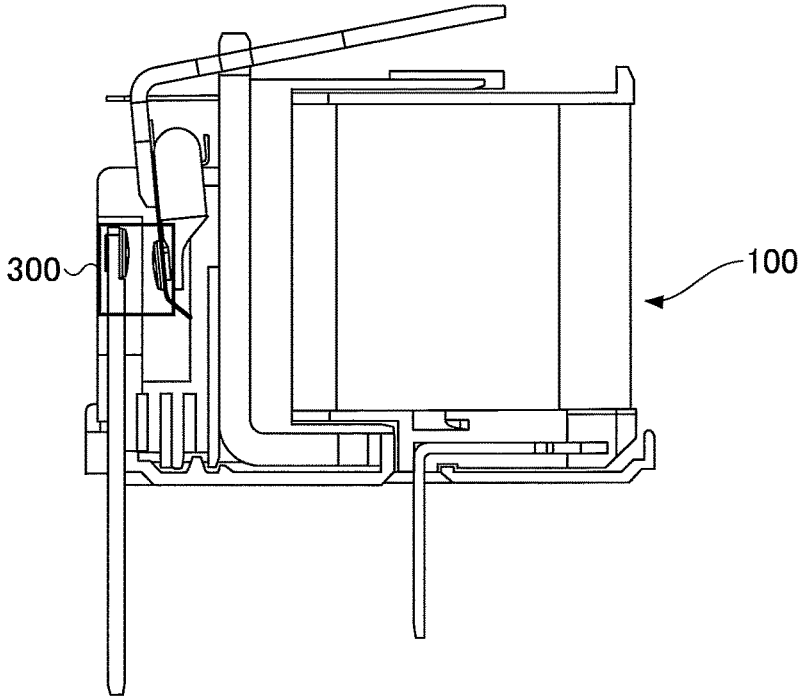
FIG. 3A is a drawing illustrating an example of the configuration of a fixed contact.
Figure 3B:
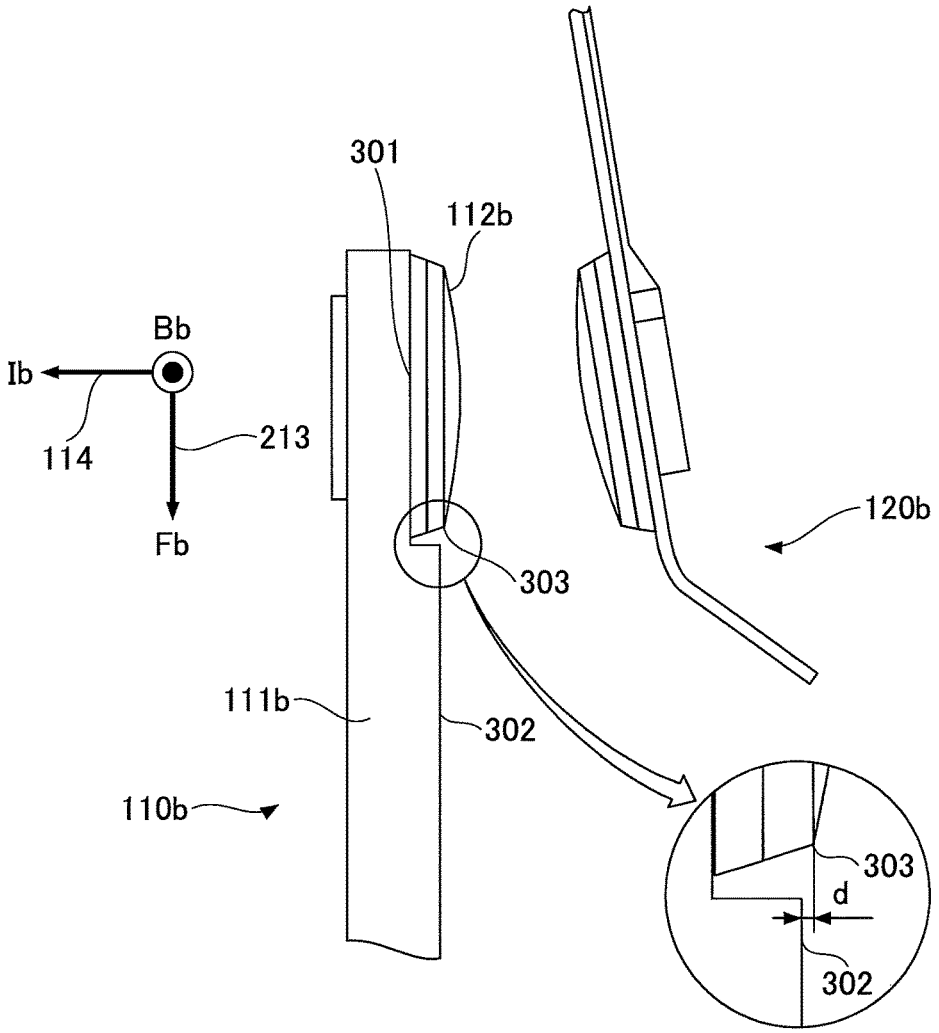
FIG. 3B is a drawing illustrating an example of the configuration of a fixed contact.

FIGS. 3A and 3B illustrate an example of the configuration that avoids an abrupt surface change by reducing the size of a step between the fixed contact spring 111*b* and the fixed contact point 112*b* at the fixed contact 110*b*.

FIG. 3A is a side elevation view of the electromagnetic relay 100 having the fixed contact 110*b* and the movable contact 120*b*. FIG. 3B is an enlarged view of an area 300 (between the fixed contact 110*b* and the movable contact 120*b*) illustrated in FIG. 3A.

As illustrated in FIG. 3B, the fixed contact 110*b* is configured to avoid an abrupt surface change between the fixed contact point 112*b* and the fixed contact spring 111*b* in the direction in which the Lorenz force Fb is applied (i.e., in the direction of an arrow 213). Specifically, the thickness of a tip area 301 of the fixed contact spring 111*b* is made thinner than the other areas, and the fixed contact point 112*b* is disposed at the tip area 301, such that the step between the fixed contact spring 111*b* and the perimeter of the fixed contact point 112*b* toward the direction of the arrow 213 has a reduced step size.

Namely, the provision of the tip area 301 of the fixed contact spring 111*b* thinner than the other areas serves to reduce a step size d between a surface 302 of the fixed contact spring 111*b* and a perimeter 303 of the fixed contact point 112*b* toward the direction of the arrow 213, compared with the case in which such thinning is not performed. As a result, arc discharge is not regenerated at the step between the perimeter 303 of the fixed contact point 112*b* and the surface of the fixed contact spring 112*b*, which serves to promptly extinguish arc discharge.

Although an example of the configuration of the fixed contact 110*b* has been described in connection with FIG. 3B, the same also applies to the configuration of the fixed contact 110*a*.

In the case of the electromagnetic relay 100 being used for a direct-current load, the degree of the effect of the step between the perimeter of the contact point and the surface of the contact spring differs depending on the polarity of plus and minus. Because of this, the provision of a reduced step only at the fixed contact as illustrated in FIG. 3B, without such a provision at the movable contact, serves to improve the capacity to promptly extinguish arc discharge.

Especially when the diameter of the fixed contact point 112*b* is large, it is difficult to make the fixed contact point 112*b* having a reduced thickness while retaining a round shape on the contact surface. Because of this, the above-noted configuration providing a reduced step size d by reducing the thickness of the tip area 301 of the fixed contact spring 111*b* compared to the other areas is particularly effective when the diameter of the fixed contact point 112*b* is large. It may be noted that the reason why the contact point having a large diameter is used is that a longer product life is achieved compared to the use of a small contact-point diameter even in the case in which large electric current flows through the contact point.

<4. Method of Mounting Fixed Contact Point>

In the following, a description will be given of the method of mounting the fixed contact point 112*b* to the fixed contact spring 111*b*. A general method for mounting a fixed contact point to a fixed contact spring may include brazing. In the case of brazing, however, dimension accuracy is poor, and a process of melting a filler metal is required, which inevitably contributes to a cost increase.

In consideration of this, the electromagnetic relay 100 of the present embodiment utilizes riveting for the purpose of mounting a contact member for use as a fixed contact point to the fixed contact spring 111*b*. FIGS. 4A through 4D are drawings illustrating a method of mounting a contact member 410*b* to the fixed contact spring 111*b* by riveting.

Figure 4A:
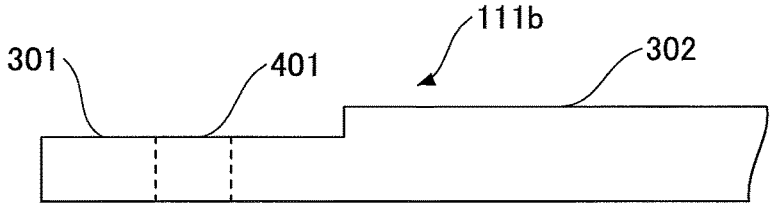
FIG. 4A is a drawing illustrating a method of mounting a contact member to a fixed contact spring by riveting.
Figure 4B:
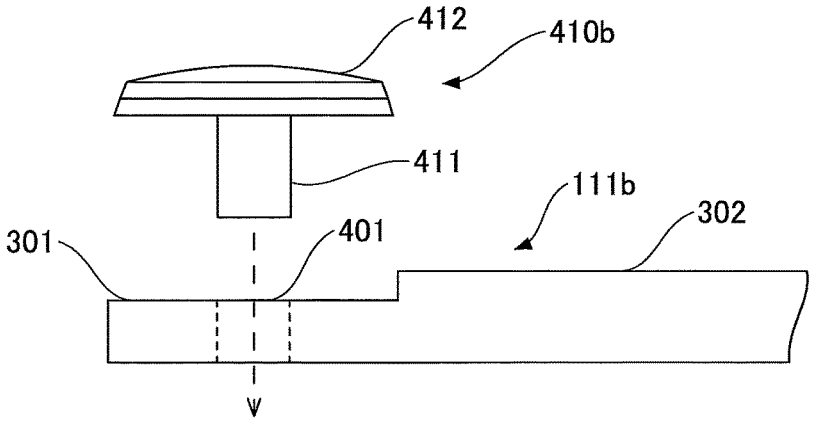
FIG. 4B is a drawing illustrating a method of mounting a contact member to a fixed contact spring by riveting.
Figure 4C:
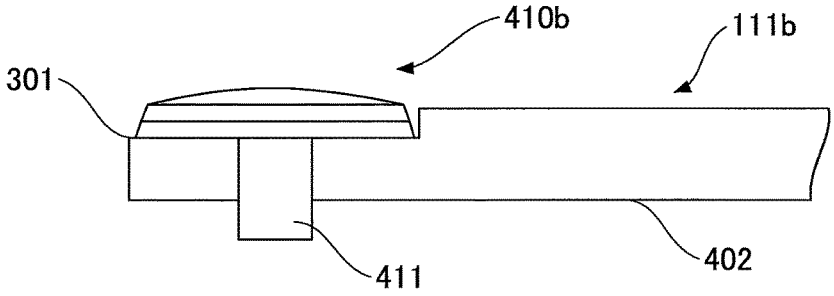
FIG. 4C is a drawing illustrating a method of mounting a contact member to a fixed contact spring by riveting.

As illustrated in FIG. 4A, the tip area 301 of the fixed contact spring 111*b* has a penetrating hole 401 formed therein. As illustrated in FIG. 4B, a shaft 411 of the contact member 410*b* having a rivet structure is inserted into the penetrating hole 401. As a result, a mounted configuration as illustrated in FIG. 4C is obtained in which the lower face of a head 412 of the contact member 410*b* having a rivet structure is in surface contact with the surface of the tip area 301.

Figure 4D:
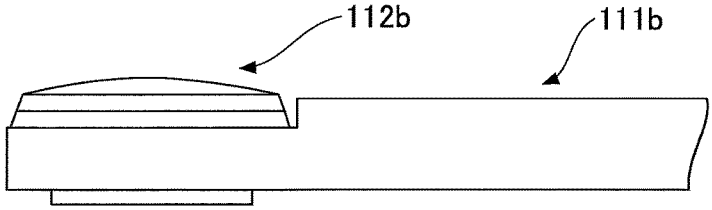
FIG. 4D is a drawing illustrating a method of mounting a contact member to a fixed contact spring by riveting.

In this state, the shaft 411 of the contact member 410*b* is swaged from the opposite side (i.e., from the same side as a back face 402) of the fixed contact spring 111*b*. Namely, the tip end of the shaft 411 is deformed with a force. As a result, the contact member 410*b* is bonded to the fixed contact spring 111*b* as illustrated in FIG. 4D to constitute the fixed contact point 112*b*. The head 412 has a larger diameter than the penetrating hole 401, and the shaft 411 has the same diameter as the penetrating hole 401.

Attaching a fixed contact point to a fixed contact spring by riveting as described above enables easy mounting and reduction in the mounting cost, compared with the case in which brazing is used.

<5. Summary>

As is understood from the descriptions provided heretofore, the electromagnetic relay of the present embodiment is as follows.

Permanent magnets are disposed at both lateral sides of the fixed contact and the movable contact to apply a magnetic field to generate the Lorenz force. This arrangement serves to promptly extinguish arc discharge.

The thickness of the tip area of the fixed contact spring is made thinner than the thickness of the other areas, and the fixed contact point is disposed at such a tip area, which provides a configuration in which the step has a small step size between the fixed contact spring and the perimeter of the fixed contact point toward the direction in which the Lorenz force is applied. This arrangement further enhances the capacity to promptly extinguish arc discharge.

Riveting is used for the purpose of mounting the fixed contact point to the tip area of the fixed contact spring. This arrangement allows a fixed contact point having a small size to be easily mounted at low cost.

Second Embodiment

The first embodiment described above is directed to the configuration in which the fixed contact is made by mounting a fixed contact point to a fixed contact spring by riveting. The fixed contact, however, is not limited to such a configuration. For example, a rare metal part to constitute a contact point is flattened against, and bonded to, a member constituting a fixed contact spring to form a flat clad piece, which is to constitute a fixed contact point.

Figure 5A:
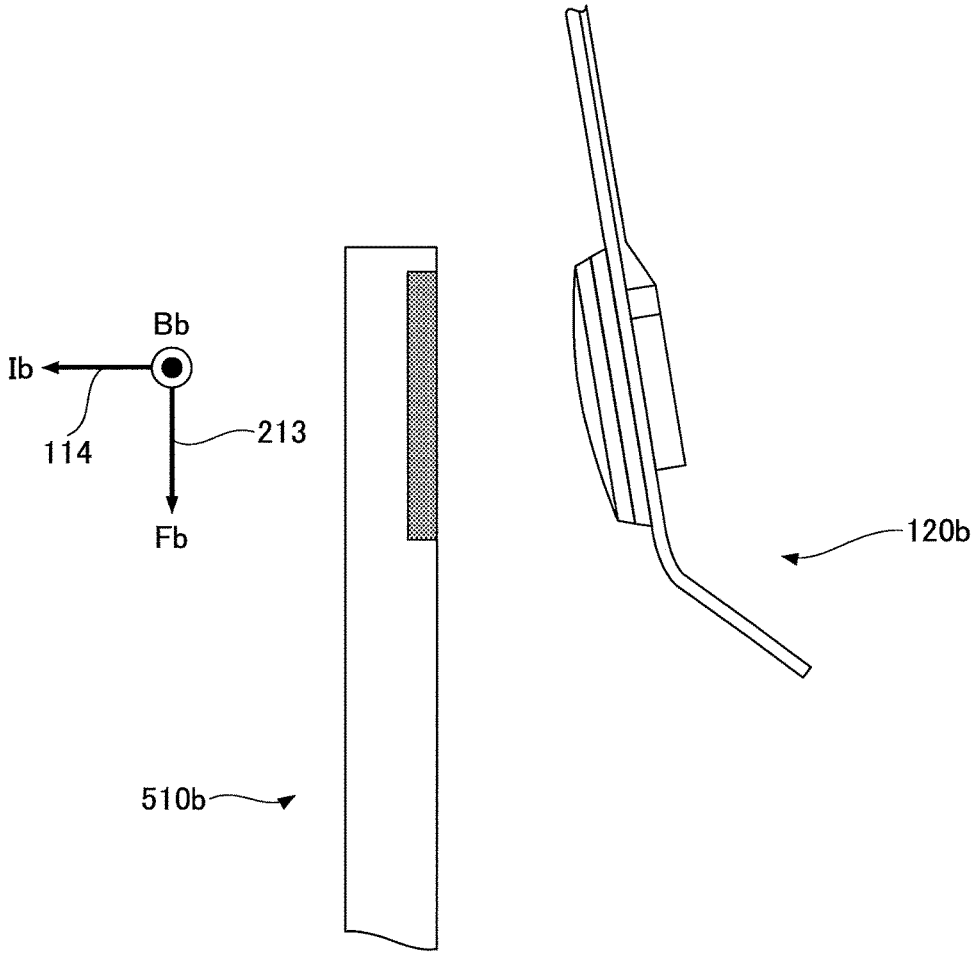
FIG. 5A is a drawing illustrating the way a fixed contact is configured by use of a clad material.
Figure 5B:
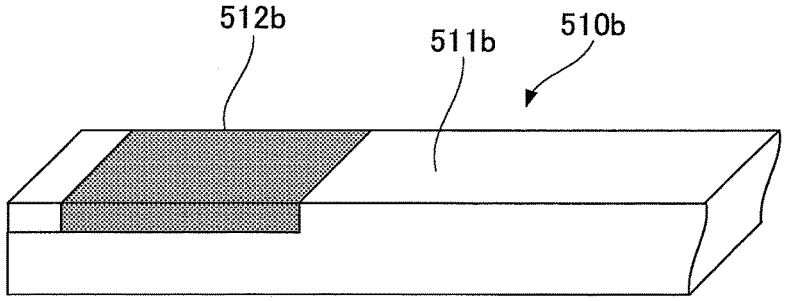
FIG. 5B is a drawing illustrating the way a fixed contact is configured by use of a clad material.

FIG. 5 is a drawing illustrating a fixed contact point made of a clad material of the present embodiment. Specifically, FIG. 5A is an enlarged view of a fixed contact 510*b* and a movable contact 120*b*. FIG. 5B is an oblique view of the fixed contact 510*b* made of the clad material.

As illustrated in FIG. 5B, the fixed contact 510*b* is configured such that the rare metal material constituting a fixed contact point 512*b* is embedded in, and integrated into, the recess formed in the metal constituting a fixed contact spring 511*b*. Because of this, there is no step between the fixed contact point 512*b* and the fixed contact spring 511*b*, which provides a flat shape. The fixed contact 510*b* having such a configuration serves to further improve the performance of promptly extinguishing arc discharge.

In the case of the use of a clad material, further, there is no need to work on a fixed contact spring such as to make the thickness of the tip area thinner than the thickness of the other areas as in the case of the use of riveting for mounting a fixed contact point. Moreover, there is no need to make the thickness of the head of the fixed contact point as thin as possible in order to reduce a step size between the perimeter of the fixed contact point and the surface of the fixed contact spring.

Namely, the use of a clad material for a fixed contact enables easier manufacturing of the fixed contact as well as to improve the performance of arc suppression.

Third Embodiment

The second embodiment described above is directed to the case in which a clad material is used for the fixed contact. The present invention is not limited to such a configuration. For example, a clad material may be used for both a fixed contact and a movable contact.

Figure 6:
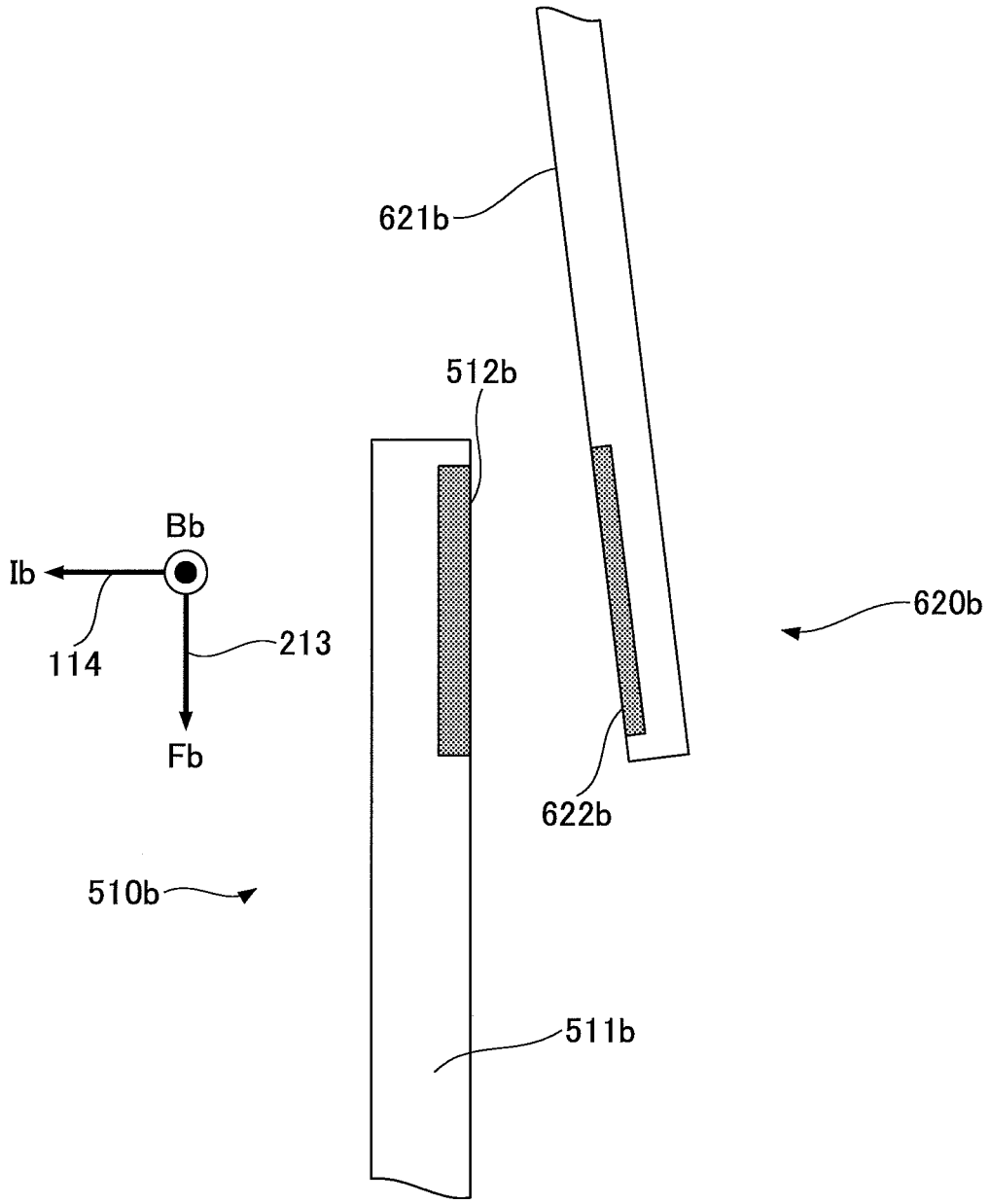
FIG. 6 is a drawing illustrating the way a fixed contact and a movable contact are configured by use of clad materials.

FIG. 6 is a drawing illustrating the way a fixed contact and a movable contact are configured by use of clad materials. As illustrated in FIG. 6, a movable contact 620*b* is configured such that the rare metal material constituting a movable contact point 622*b* is embedded in, and integrated into, the metal constituting a movable contact spring 621*b*. Because of this, there is no step between the perimeter of the movable contact point 622*b* and the surface of the movable contact spring 621*b*. As a result, the performance of promptly extinguishing arc discharge is further improved.

Fourth Embodiment

The above-noted embodiments have been described based on the premise that the Lorenz force is applied downwardly. However, the direction in which the Lorenz force is applied is not limited to the downward direction. For example, the direction of polarity of the permanent magnets 221*a*, 222*a*, 221*b*, and 222*b* may be set such as to apply the Lorenz force in the upward direction. It may be noted that in this case, a step between the surface of the contact spring and the perimeter of the contact point toward the upper side is made small. This is for the purpose of preventing arc discharge to be regenerated at the step between the surface of the contact spring and the upper side of the perimeter of the contact point after arc discharge is blown away toward the upper direction.

The present invention is not limited to the configurations of the embodiments heretofore described. The disclosed configurations may be combined with other elements to be modified without departing from the scope of the present invention, and may be determined properly in response to the mode of practical application.

The present application claims foreign priority to Japanese priority application No. 2014-138120 filed on Jul. 3, 2014, with the Japanese Patent Office, the entire contents of which are hereby incorporated by reference.

DESCRIPTION OF REFERENCE SYMBOLS

100: electromagnetic relay
110*a*, 110*b*, 510*b*: fixed contact
111*a*, 111*b*, 511*b*: fixed contact spring
112*a*, 112*b*, 512*b*: fixed contact point
120*a*, 120*b*, 620*b*: movable contact
121*a*, 121*b*, 621*b*: movable contact spring
122*a*, 122*b*, 622*b*: movable contact point
130: electromagnet device
131: armature
132: iron core
133: wire coil
134: drive yoke
135: hinge spring
136: retaining member
140: base mold
150: bottom plate
160: terminals
170: terminals
221*a*, 222*a*: permanent magnet
221*b*, 222*b*: permanent magnet
301: tip area
302: surface
303: perimeter
401: penetrating hole
402: back face
410*b*: contact member
411: shaft
412: head

The invention claimed is:

1. An electromagnetic relay, comprising:

a fixed contact having a fixed contact plate and a fixed contact point mounted to the fixed contact plate;

a movable contact having a movable contact plate and a movable contact point mounted to the movable contact plate; and an electromagnet device configured to move the movable contact so as to bring the movable contact point in contact with the fixed contact point, wherein a contact plate that is at least one of the fixed contact plate and the movable contact plate is a single, continuous metal piece that has a first portion having a first thickness and a second portion having a second thickness thinner than the first thickness, the second portion serving as a contact area and having a penetrating hole formed therethrough, and the contact point of the contact plate has a head and a shaft, and wherein while the shaft is placed in the penetrating hole such that the head is mounted on a first surface of the contact area, an end of the shaft is deformed with a force at a second surface opposite the first surface to mount the contact point to the contact plate.

2. The electromagnetic relay as claimed in claim 1, wherein the fixed contact includes two fixed contact points, and the movable contact includes two movable contact points facing the two fixed contact points, a movement of the movable contact causing the two movable contact points to come in contact with the two fixed contact points facing thereto, thereby providing an electrical connection between the two fixed contact points.

3. The electromagnetic relay as claimed in claim 1, wherein the head has a larger diameter than the penetrating hole, and the shaft has the same diameter as the penetrating hole.

4. An electromagnetic relay, comprising:

a fixed contact having a fixed contact plate and a fixed contact point mounted to the fixed contact plate;

a movable contact having a movable contact plate and a movable contact point mounted to the movable contact plate; and an electromagnet device configured to move the movable contact so as to bring the movable contact point in contact with the fixed contact point, wherein at least one of the fixed contact and the movable contact is made of a flat clad member made by bonding a member constituting a contact point to a member constituting a contact plate, no step being in existence between the contact point and the contact plate.

5. The electromagnetic relay as claimed in claim 4, wherein the fixed contact includes two fixed contact points, and the movable contact includes two movable contact points facing the two fixed contact points, a movement of the movable contact causing the two movable contact points to come in contact with the two fixed contact points facing thereto, thereby providing an electrical connection between the two fixed contact points.

* * * * *